US009704341B2

(12) United States Patent
Wolf et al.

(10) Patent No.: US 9,704,341 B2
(45) **Date of Patent: *Jul. 11, 2017**

(54) METHOD AND APPARATUS FOR REWARDING MULTIPLE GAME PLAYERS FOR A SINGLE WIN

(71) Applicant: IGT, Las Vegas, NV (US)

(72) Inventors: Bryan D. Wolf, Reno, NV (US); Gregory A. Schlottman, Sparks, NV (US); William R. Brosnan, Reno, NV (US)

(73) Assignee: IGT, Las Vegas, NV (US)

( * ) Notice: Subject to any disclaimer, the term of this patent is extended or adjusted under 35 U.S.C. 154(b) by 847 days.

This patent is subject to a terminal disclaimer.

(21) Appl. No.: 14/053,316

(22) Filed: Oct. 14, 2013

(65) Prior Publication Data

US 2014/0038705 A1 Feb. 6, 2014

Related U.S. Application Data

(60) Continuation of application No. 12/039,523, filed on Feb. 28, 2008, now Pat. No. 8,562,423, which is a continuation of application No. 10/931,716, filed on Sep. 1, 2004, now Pat. No. 7,351,140, which is a division of application No. 10/109,102, filed on Mar. 28, 2002, now Pat. No. 7,500,915.

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/3262* (2013.01); *G07F 17/32* (2013.01); *G07F 17/3225* (2013.01); *G07F 17/34* (2013.01); *G07F 17/3244* (2013.01); *G07F 17/3255* (2013.01); *G07F 17/3258* (2013.01)

(58) Field of Classification Search

CPC .. G07F 17/32; G07F 17/3244; G07F 17/3255; G07F 17/3258

USPC ..... 463/16, 20, 25

See application file for complete search history.

(56) References Cited

U.S. PATENT DOCUMENTS

| | | | |
|---|---|---|---|
| 5,116,055 | A | 5/1992 | Tracy |
| 5,564,700 | A | 10/1996 | Celona |
| 5,655,961 | A | 8/1997 | Acres et al. |
| 5,766,076 | A | 6/1998 | Pease et al. |
| 5,876,284 | A | 3/1999 | Acres et al. |
| 6,077,162 | A | 6/2000 | Weiss |

(Continued)

FOREIGN PATENT DOCUMENTS

| | | |
|---|---|---|
| AU | 199924973 | 11/1999 |
| AU | 20030185 | 11/2000 |

(Continued)

OTHER PUBLICATIONS

English translations of claims 1 to 5 from RU 17678U1.

*Primary Examiner* — William H McCulloch, Jr.
*Assistant Examiner* — Chase Leichliter
(74) *Attorney, Agent, or Firm* — Neal, Gerber & Eisenberg LLP

(57) ABSTRACT

A gaming apparatus and method is provided that is capable of rewarding a distributed jackpot to players using gaming units that are electronically linked to one another. The distributed jackpot may be shared among non-winning players when a winning result is achieved by a winning player.

24 Claims, 14 Drawing Sheets

(56) References Cited

U.S. PATENT DOCUMENTS

| | | | |
|---|---|---|---|
| 6,089,980 | A | 7/2000 | Gauselmann |
| 6,110,043 | A | 8/2000 | Olsen |
| 6,142,872 | A | 11/2000 | Walker et al. |
| 6,186,894 | B1 | 2/2001 | Mayeroff |
| 6,206,782 | B1 | 3/2001 | Walker et al. |
| 6,319,122 | B1 | 11/2001 | Packes |
| 6,347,996 | B1 | 2/2002 | Gilmore et al. |
| 6,358,149 | B1 | 3/2002 | Schneider et al. |
| 6,375,567 | B1 | 4/2002 | Acres |
| 6,375,568 | B1 | 4/2002 | Roffman et al. |
| 6,416,409 | B1 | 7/2002 | Jordan |
| 6,592,460 | B2 | 7/2003 | Torango |
| 2001/0034649 | A1 | 10/2001 | Acres |
| 2001/0046891 | A1 | 11/2001 | Acres |
| 2003/0036430 | A1 | 2/2003 | Cannon |
| 2003/0181231 | A1 | 9/2003 | Vancura et al. |
| 2005/0054430 | A1 | 3/2005 | Pitman et al. |

FOREIGN PATENT DOCUMENTS

| | | |
|---|---|---|
| AU | 199924974 | 11/2000 |
| EP | 855 074 | 7/1998 |
| RU | 17678 U1 | 4/2001 |
| WO | WO 97/49073 | 12/1997 |

FIG. 10
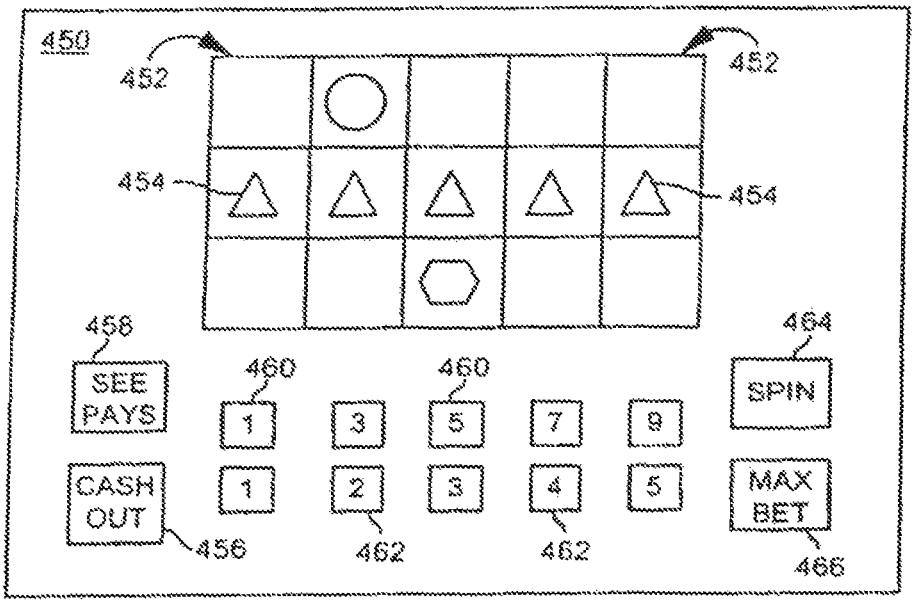
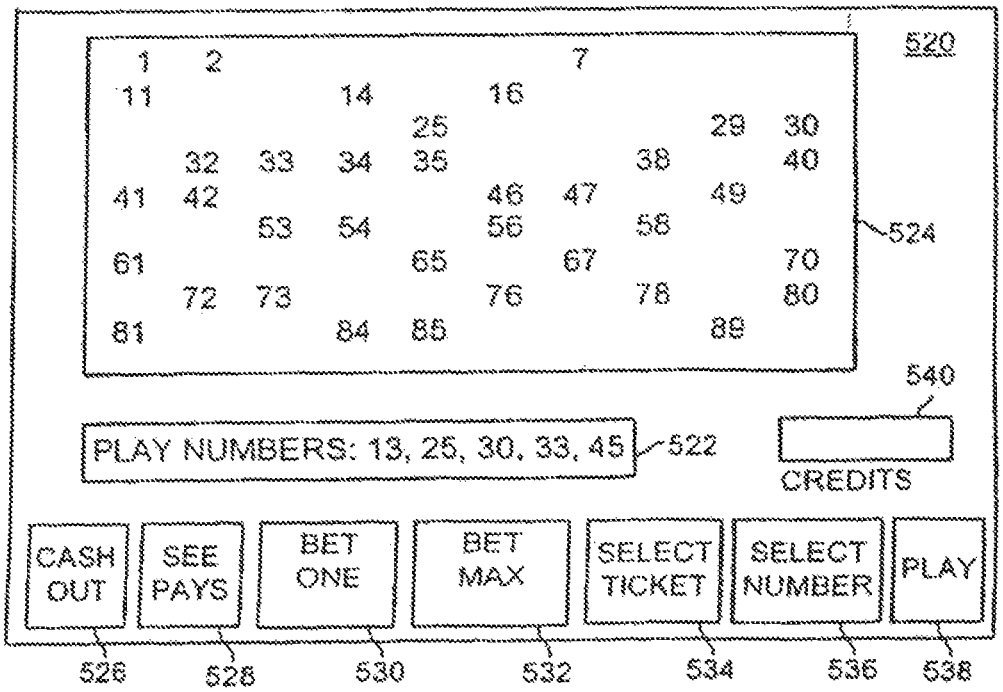
FIG. 11

METHOD AND APPARATUS FOR REWARDING MULTIPLE GAME PLAYERS FOR A SINGLE WIN

PRIORITY CLAIM

This application is a continuation application of, claims priority to and the benefit of U.S. patent application Ser. No. 12/039,523, filed on Feb. 28, 2008, which is a continuation application of, claims priority to and the benefit of U.S. patent application Ser. No. 10/931,716, filed on Sep. 1, 2004, now U.S. Pat. No. 7,351,140, which is a divisional application of, claims priority to and the benefit of U.S. patent application Ser. No. 10/109,102, filed on Mar. 28, 2002, now U.S. Pat. No. 7,500,915, the entire contents of which are incorporated by reference herein.

BACKGROUND OF THE INVENTION

Gaming systems are common devices in casinos or other establishments. Such gaming systems typically include one or more gaming units, each capable of facilitating the play of one or more games such as, for example, slots, video blackjack, video poker, keno, and bingo.

Progressive gaming systems have been developed in which gaming units are electronically linked to one another and/or to a host computer. (The progressive gaming system may be configured such that one or more of the electronically linked gaming units serves as a host computer.) The electronically linked gaming units can be located near or far from one another and may even be located in separate casinos, such as in a so-called wide are progressive ("WAP") network.

Electronically linking the gaming units permits the gaming units to be configured in a group, so that people using each of the gaming units in the group each add to, and each have a chance to win, a progressive jackpot. The progressive jackpot grows in magnitude with each wager made on any one of the group of gaming units in the progressive gaming system. Accordingly, if a large number of gaming units form the group in the progressive gaming system, the progressive jackpot may be dramatically bigger than the jackpot for each gaming unit if the gaming units were configured in a stand-alone manner.

One example of a progressive gaming system operates as follows. A player begins a game by wagering an amount of money at a gaming unit that is linked to other similar gaming units and to a host computer to form a progressive network. A fraction of the wager is allocated to a progressive jackpot. The amount of the progressive jackpot is then communicated to each of the gaming units in the progressive network, and may be displayed on each of the gaming units in the progressive network and/or on a large overhead electronic sign in the vicinity of one or more of the gaming units in the progressive network.

In such a progressive gaming system, in the event that one of the gaming units in the progressive network yields a winning game outcome that is associated with a progressive jackpot, the winning game outcome is communicated to the host computer. The host computer may be programmed to respond to this communication by performing a number of security checks, such as verifying that the winning game outcome is correct and that the gaming unit that yielded the winning game outcome was not tampered with. If this security check leads to a conclusion that the winning game outcome is invalid, the invalid winning game outcome is rejected and no payout is made.

If the host computer determines that the winning game outcome is valid, the host computer communicates an acknowledgement of the winning game outcome to the winning gaming unit. The host computer then communicates, to the entity or entities responsible for paying the winning player (which may be a gaming casino and/or a host company, if the progressive network includes gaming units in more than one location), the amount to be paid to the winning player. Finally; the host computer resets the progressive jackpot to a base value and communicates the new progressive jackpot to all of the gaming units in the progressive network.

SUMMARY OF THE INVENTION

In accordance with one aspect of the invention, a gaming apparatus may include a display unit that is capable of generating video images, a value input device, and a controller operatively coupled to the display unit and the value input device. The controller may include a processor and a memory operatively coupled to the processor, and may be programmed to allow a person to make a wager. The controller may also be programmed to cause a video image to be generated on the display unit. The video image may represent a game, such as video poker, video blackjack, video slots, video keno or video bingo. The controller may be programmed to determine a value payout associated with an outcome of the game, to compare the value payout to a threshold amount, and to generate a distributed jackpot payout message if the value payout is greater than or equal to the threshold amount.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 10 is an illustration of an embodiment of a visual display that may be displayed during performance of the slots routine of FIG. 12;

FIG. 11 is an illustration of an embodiment of a visual display that may be displayed during performance of the video keno routine of FIG. 13;

DETAILED DESCRIPTION OF VARIOUS EMBODIMENTS

Although the following text sets forth a detailed description of numerous different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise; to that single meaning. Finally, it is not intended that the scope of any claim element be interpreted based on the application of 35 U.S.C. §112, sixth paragraph.

Figure 1:
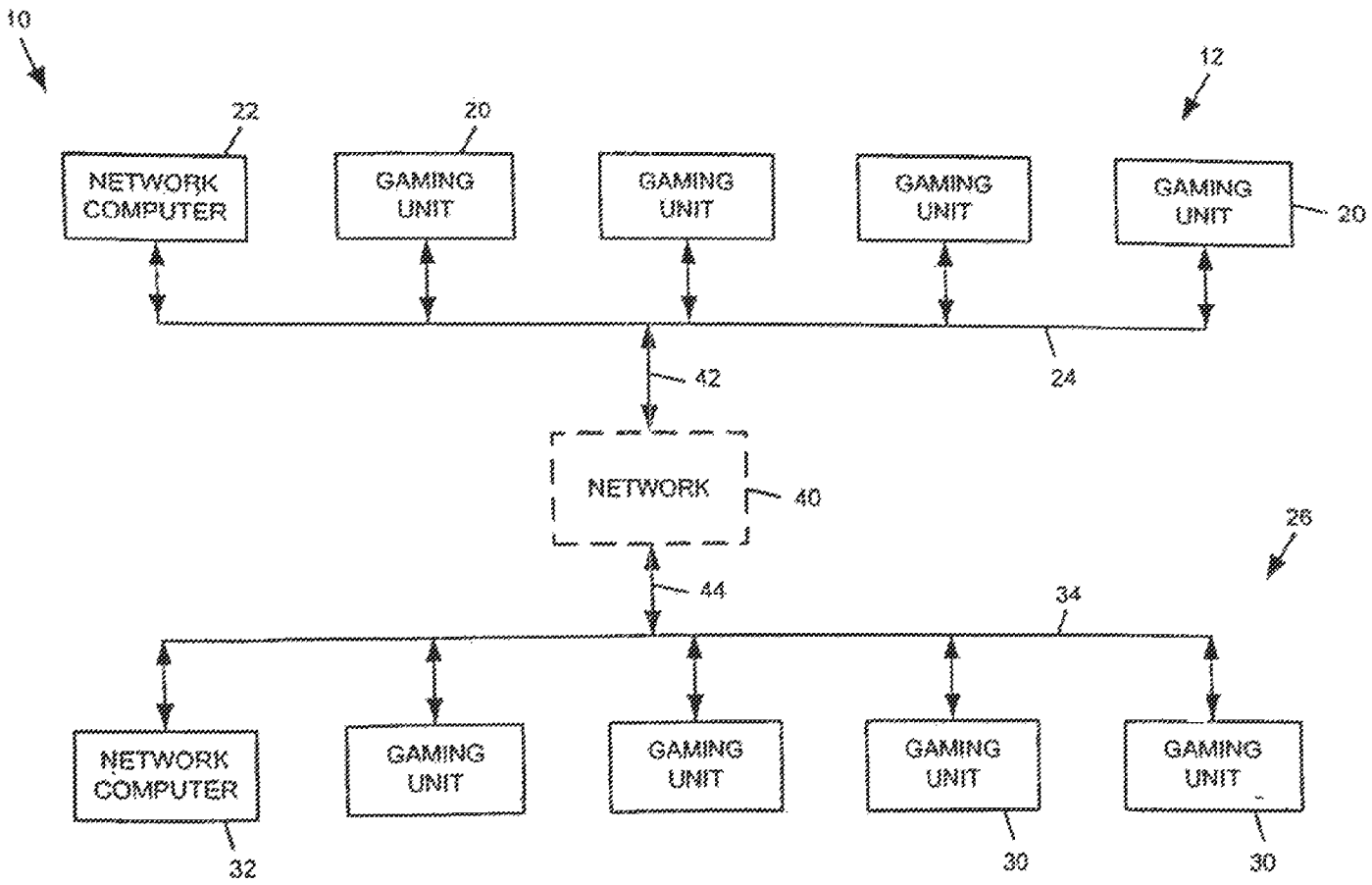
FIG. 1 is a block diagram of an embodiment of a gaming system.

FIG. 1 illustrates an embodiment of a casino gaming system 10 in accordance with the invention. Referring to FIG. 1, the casino gaming system 10 may include a first group or network 12 of casino gaming units 20 operatively coupled to a network computer 22 via a network data link or bus 24. The casino gaming system 10 may include a second group or network 26 of casino gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 42 and a second network link 44.

The first network 12 of gaming units 20 may be provided in a first casino, and the second network 26 of gaming units 30 may be provided in a second casino located in a separate geographic location than the first casino. For example, the two casinos may be located in different areas of the same city, or they may be located in different states. The network 40 may include a plurality of network computers or server computers (not shown), each of which may be operatively interconnected. Where the network 40 comprises the Internet, data communication may take place over the communication links 42, 44 via an Internet communication protocol.

The network computer 22 may be a host computer, a server computer, or one of the gaming units 20, and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits of players playing each of the gaming units 20, etc. The network computer 32 may be a server computer and may be used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

Figure 2:
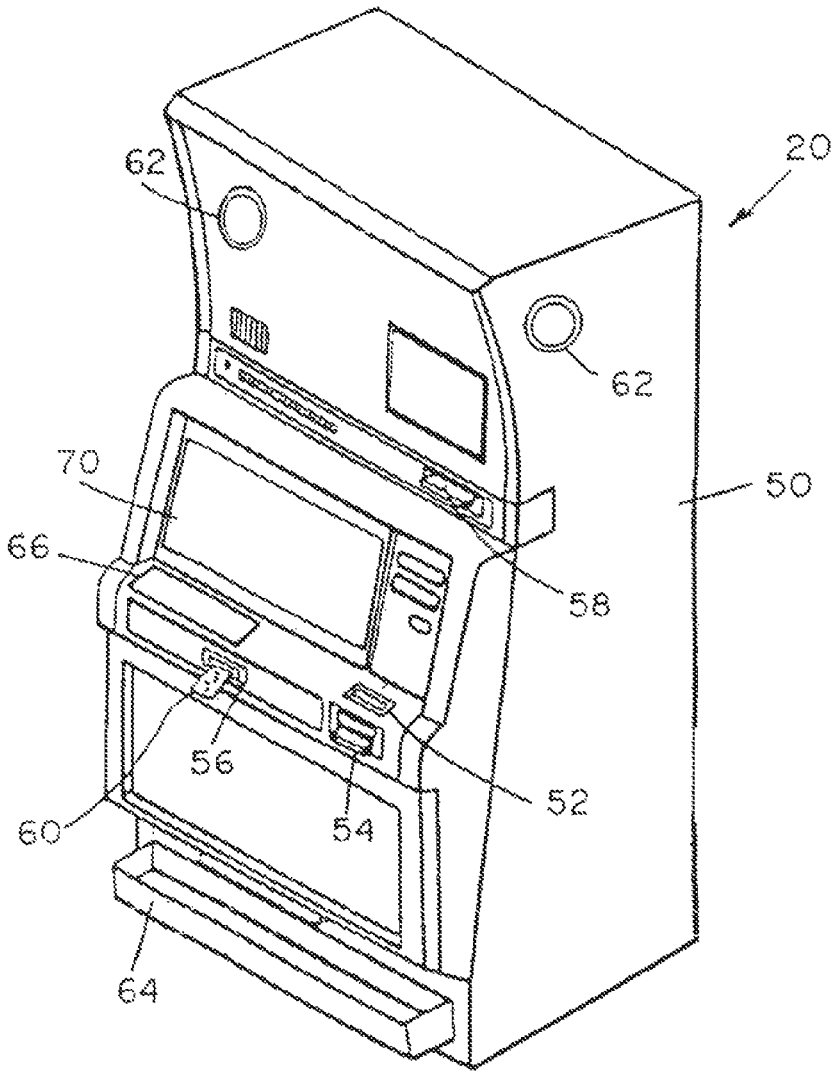
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50 and one or more input devices, which may include a coin slot or acceptor 52, a paper currency acceptor 54, a ticket reader/printer 56 and a card reader 58, which may be used to input value to the gaming unit 20. A value input device may include any device that can accept value from a customer. As used herein, the term "value" may encompass gaming tokens, coins, paper currency, ticket vouchers, credit or debit cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from a card offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, etc.

The gaming unit 20 may include one or more audio speakers 62, a coin payout tray 64, an input control panel 66, and a color video display unit 70 for displaying images relating to the game or games provided by the gaming unit 20. Such images may include distributed jackpot information. The audio speakers 62 may generate audio representing sounds such as the noise of spinning slot machine reels, a dealer's voice, music, announcements or any other audio related to a casino game. The input control panel 66 may be provided with a plurality of pushbuttons or touch-sensitive areas that may be pressed by a player to select games, make wagers, make gaming decisions, etc.

Figure 2A:
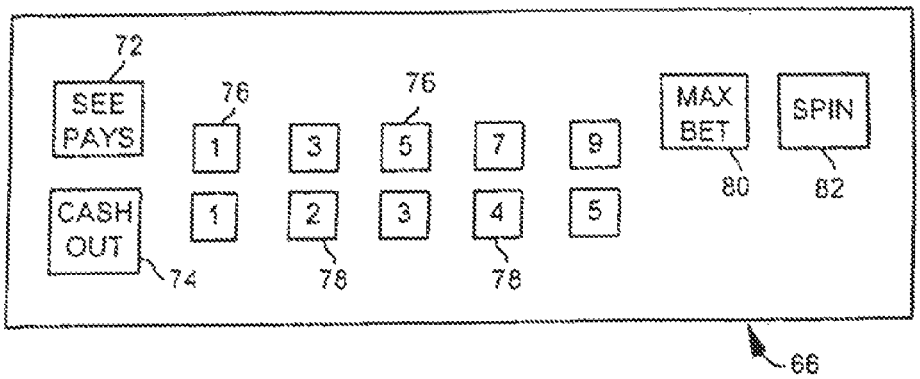
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information (which may include distributed jackpot information) for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74, 76, 78, 80, 82. It should be understood that that rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Gaming Unit Electronics

Figure 3:
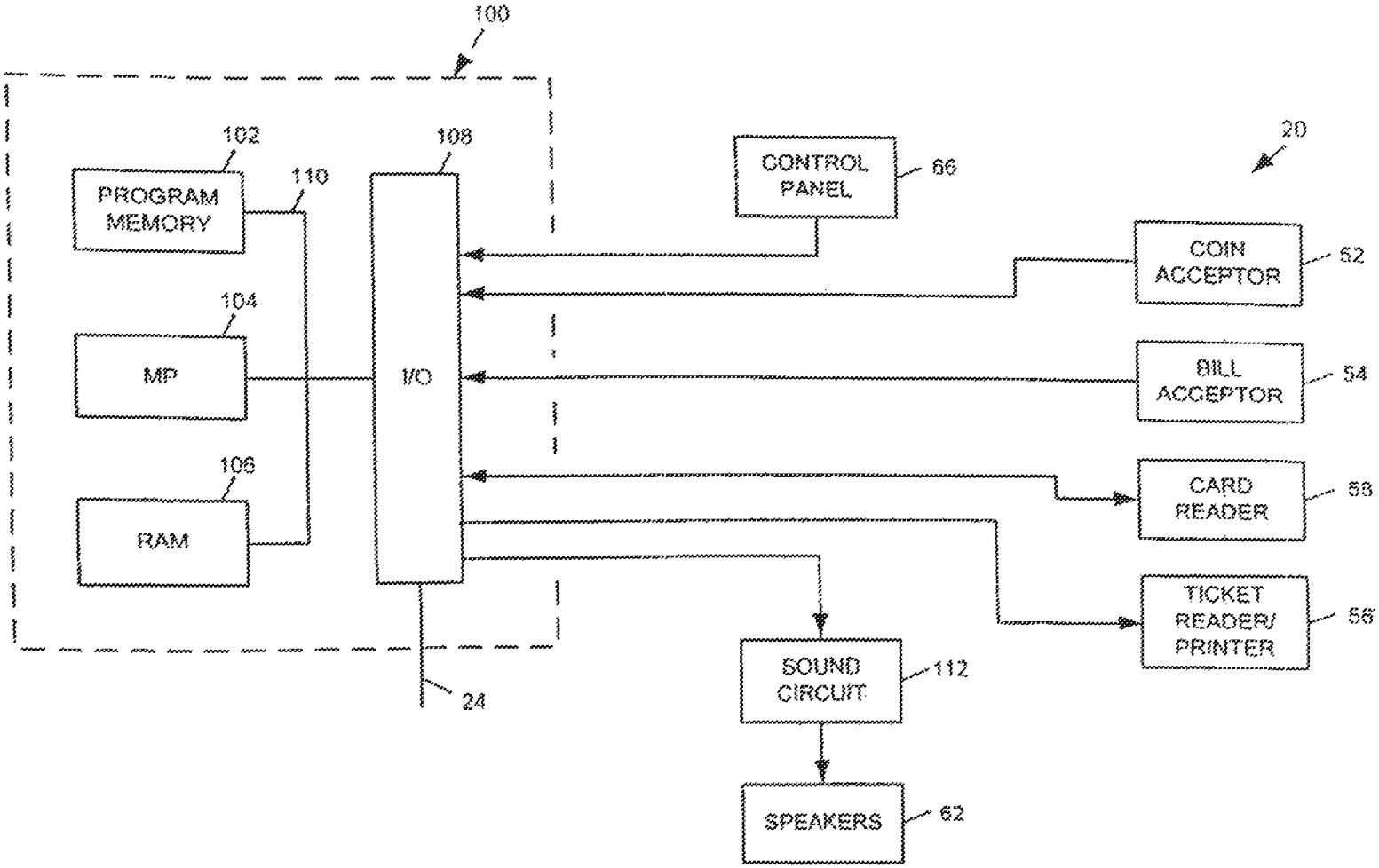
FIG. 3 is a block diagram of the electronic components of the gaming unit of FIG. 2.

FIG. 3 is a block diagram of a number of components that may be incorporated in the gaming unit 20. Referring to FIG. 3, the gaming unit 20 may include a controller 100 that may comprise a program memory 102, a microcontroller or microprocessor (MP) 104, a random-access memory (RAM.) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the I/O circuit 108 is shown as a single block, it should be appreciated that the I/O circuit 108 may include a number of different types of I/O circuits. The RAM(s) 104 and program memories 102 may be implemented as semiconductor memories, magnetically readable memories, and/or optically readable memories, for example.

FIG. 3 illustrates that the control panel 66, the coin acceptor 52, the bill acceptor 54, the card reader 58 and the ticket reader/printer 56 may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice- and sound-synthesis circuit or that may comprise a driver circuit. The sound-generating circuit 112 may be coupled to the I/O circuit 108.

As shown in FIG. 3, the components 52, 54, 56, 58, 66, 112 may be connected to the I/O circuit 108 via a respective direct line or conductor. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108.

Overall Operation of Gaming Unit

One manner in which one OF more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C+, C++ or the like or any low-level, assembly or machine language. By storing the computer program portions therein, various portions of the memories 102, 106 are physically and/or structurally configured in accordance with computer program instructions.

Figure 4:
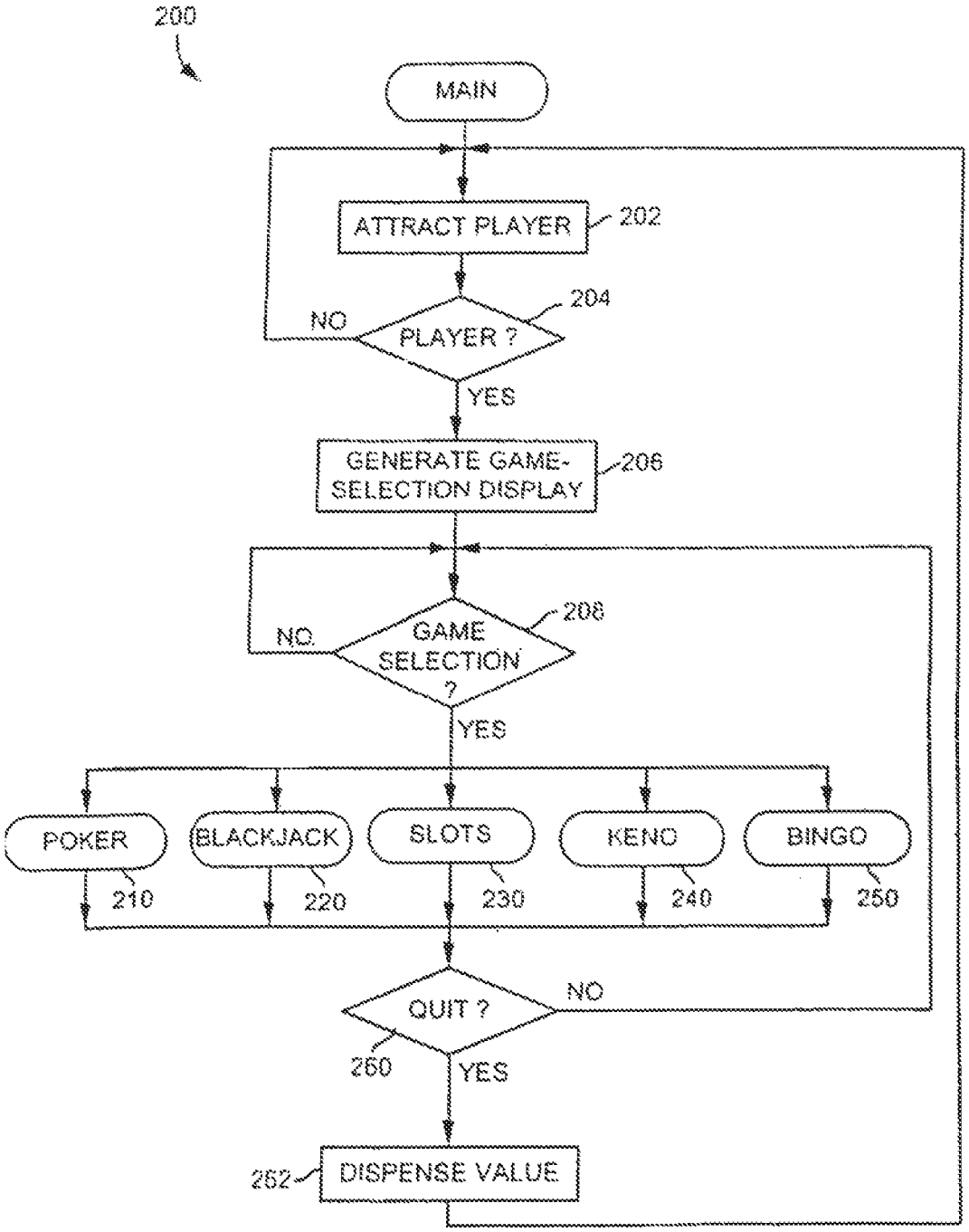
FIG. 4 is a flowchart of an embodiment of a main routine that may be performed during operation of one or more of the gaming units.

FIG. 4 is a flowchart of a main operating routine 200 that may be stored in the memory of the controller 100. Referring to FIG. 4, the main routine 200 may begin operation at block 202 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, etc.

During performance of the attraction sequence, if a potential player makes any input to the gaming unit 20 as determined at block 204, the attraction sequence may be terminated and a game-selection display may be generated on the display unit 70 at block 206 to allow the player to select a game available on the gaming unit 20. The gaming unit 20 may detect an input at block 204 in various ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit 20; etc.

The game-selection display generated at block 206 may include, for example, a list of video games that may be played on the gaming unit 20 and/or a visual message to prompt the player to deposit value into the gaming unit 20. While the game-selection display is generated, the gaming unit 20 may wait for the player to make a game selection. Upon selection of one of the games by the player as determined at block 208, the controller 100 may cause one of a number of game routines to be performed to allow the selected game to be played. For example, the game routines could include a video poker routine 210, a video blackjack routine 220, a slots routine 230, a video keno routine 240, and a video bingo routine 250. At block 208, if no game selection is made within a given period of time, the operation may branch back to block 202.

After one of the game routines 210, 220, 230, 240, 250 has been performed to allow the player to play one of the games, block 260 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player at block 262 based on the outcome of the game(s) played by the player. The operation may then return to block 202. If the player did not wish to quit as determined at block 260, the routine may return to block 208 where the game-selection display may again be generated to allow the player to select another game.

It should be noted that although five gaming routines are shown in FIG. 4, a different number of routines could be included to allow play of a different number of games. The gaming unit 20 may also be programmed to allow play of different games.

Figure 5:
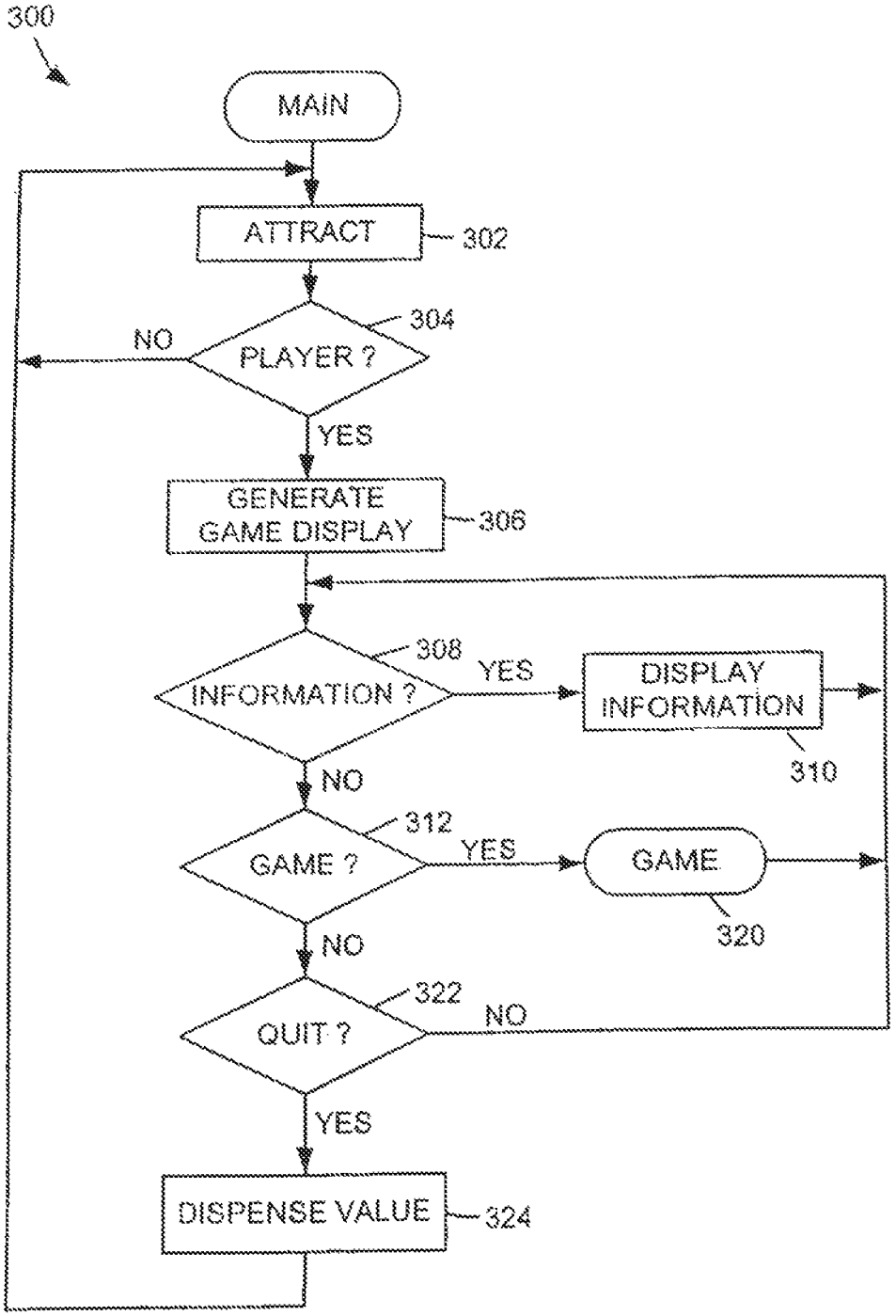
FIG. 5 is a flowchart of an alternative embodiment of a main routine that may be performed during operation of one or more of the gaming units.

FIG. 5 is a flowchart of an alternative main operating routine 300 that may be stored in the memory of the controller 100. The main routine 300 may be utilized for gaming units 20 that are designed to allow play of only a single game or single type of game. Referring to FIG. 5, the main routine 300 may begin operation at block 302 during which an attraction sequence may be performed in an attempt to induce a potential player in a casino to play the gaming unit 20. The attraction sequence may be performed by displaying one or more video images on the display unit 70 and/or causing one or more sound segments, such as voice or music, to be generated via the speakers 62.

During performance of the attraction sequence, if a potential player makes any input to the gaming unit 20 as determined at block 304, the attraction sequence may be terminated and a game display may be generated on the display unit 70 at block 306. The game display generated at block 306 may include, for example, an image of the casino game that may be played on the gaming unit 20 and/or a visual message to prompt the player to deposit value into the gaming unit 20. At block 308, the gaming unit 20 may determine if the player requested information concerning the game, in which case the requested information may be displayed at block 310. Block 312 may be used to determine if the player requested initiation of a game, in which case a game routine 320 may be performed. The game routine 320 could be any one of the game routines disclosed herein, such as one of the five game routines 210, 220, 230, 240, 250, or another game routine.

After the routine 320 has been performed to allow the player to play the game, block 322 may be utilized to determine whether the player wishes to terminate play on the gaming unit 20. If the player wishes to stop playing the gaming unit 20, which wish may be expressed, for example, by selecting a "Cash Out" button, the controller 100 may dispense value to the player at block 324 based on the outcome of the game(s) played by the player. The operation may then return to block 302. If the player did not wish to quit as determined at block 322, the operation may return to block 308.

Video Poker

Figure 6:
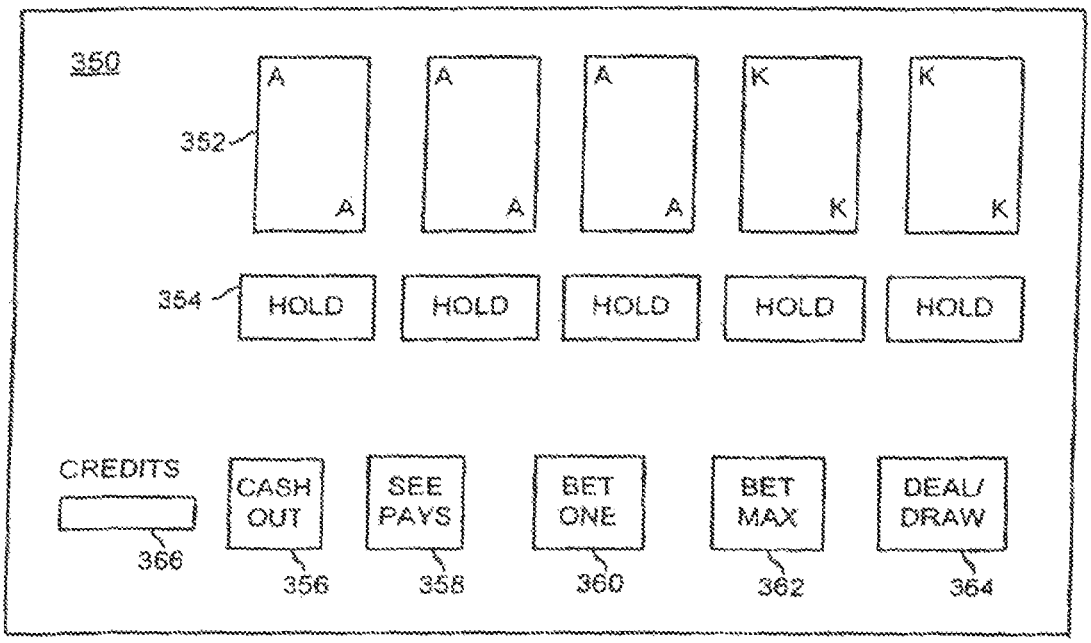
FIG. 6 is an illustration of an embodiment of a visual display that may be displayed during performance of the video poker routine of FIG. 8.

FIG. 6 is an exemplary display 350 that may be shown on the display unit 70 during performance of the video poker routine 210 shown schematically in FIG. 4. Referring to FIG. 6, the display 350 may include video images 352 of a plurality of playing cards representing the player's hand, such as five cards. To allow the player to control the play of the video poker game, a plurality of player-selectable buttons may be displayed. The buttons may include a "Hold" button 354 disposed directly below each of the playing card images 352, a "Cash Out" button 356, a "See Pays" button 358, a "Bet One Credit" button 360, a "Bet Max Credits" button 362, and a "Deal/Draw" button 364. The display 350 may also include an area 366 in which the number of remaining credits or value is displayed. If the display unit 70 is provided with a touch-sensitive screen, the buttons 354, 356, 358, 360, 362, 364 may form part of the video display 350. Alternatively, one or more of those buttons may be provided as part of a control panel that is provided separately from the display unit 70.

Figure 8:
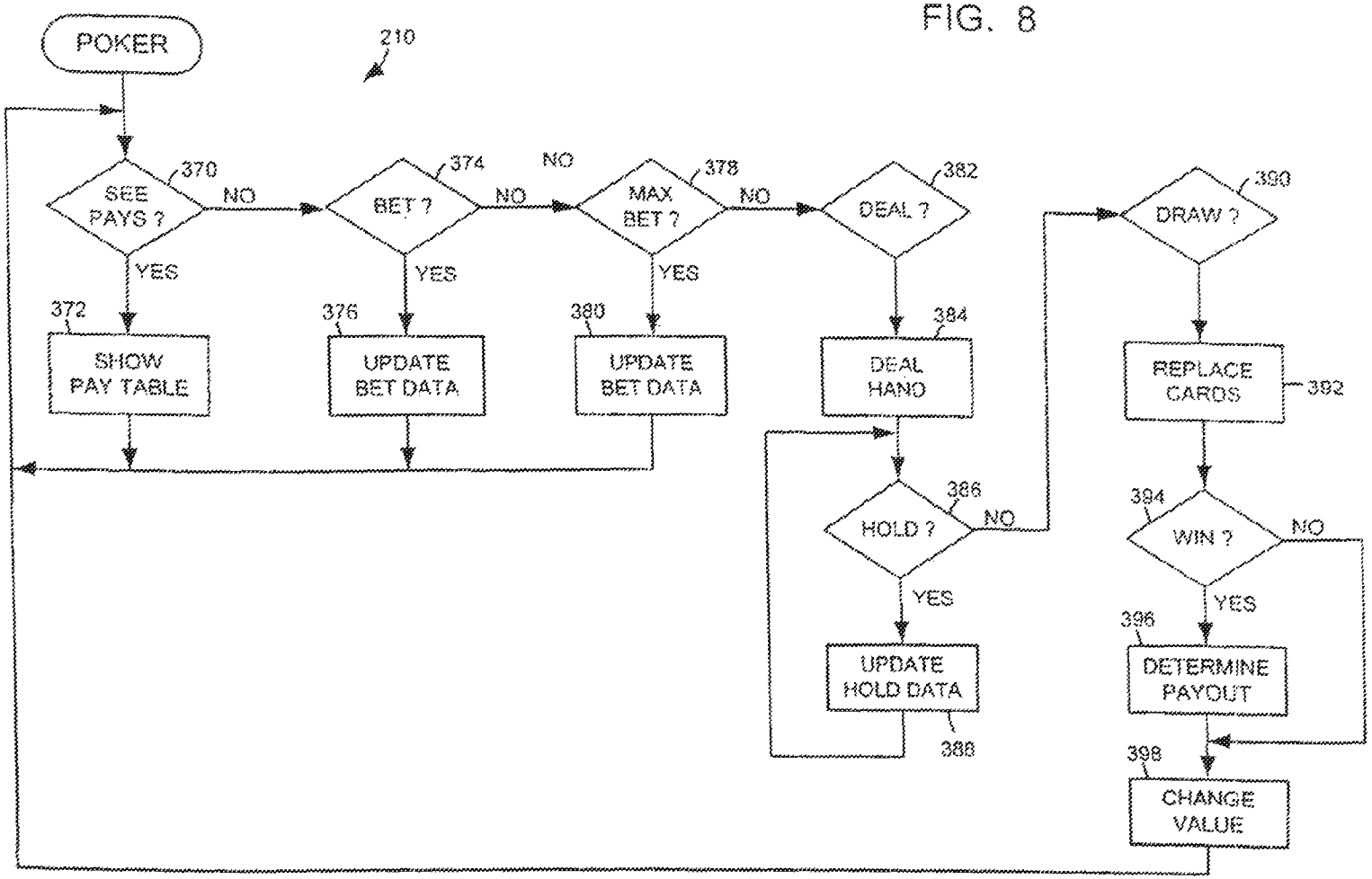
FIG. 8 is a flowchart of an embodiment of a video poker routine that may be performed by one or more of the gaming units.

FIG. 8 is a flowchart of the video poker routine 210 shown schematically in FIG. 4. Referring to FIG. 8, at block 370, the routine may determine whether the player has requested payout information, such as by activating the "See Pays" button 358, in which case at block 372 the routine may cause one or more pay tables to be displayed on the display unit 70. At block 374, the routine may determine whether the player has made a bet, such as by pressing the "Bet One Credit" button 360, in which case at block 376 bet data corresponding to the bet made by the player may be stored in the memory of the controller 100 and may also be communicated to one or more of the network computers 22, 32 and/or to the other gaming units 20, 30, for example, in order to communicate an amount of a progressive shared jackpot. At block 378, the routine may determine whether the player has pressed the "Bet Max Credits" button 362, in which case at block 380 bet data corresponding to the maximum allowable bet may be stored in the memory of the controller 100 and may also be communicated to one or more of the network computers 22, 32 and/or to the other gaming units 20, 30, for example, in order to communicate an amount of a progressive shared jackpot.

At block 382, the routine may determine if the player desires a new hand to be dealt, which may be determined by detecting if the "Deal/Draw" button 364 was activated after a wager was made. In that case, at block 384 a video poker hand may be "dealt" by causing the display unit 70 to generate the playing card images 352. After the hand is dealt, at block 386 the routine may determine if any of the "Hold" buttons 354 have been activated by the player, in which case data regarding which of the playing card images 352 are to be "held" may be stored in the controller 100 at block 388. If the "Deal/Draw" button 364 is activated again as determined at block 390, each of the playing card images 352 that was not "held" may be caused to disappear from the video display 350 and to be replaced by a new, randomly selected, playing card image 352 at block 392.

At block 394, the routine may determine whether the poker hand represented by the playing card images 352 currently displayed is a winner. That determination may be made by comparing data representing the currently displayed poker hand with data representing all possible winning hands, which may be stored in the memory of the controller 100. If there is a winning hand, a payout value corresponding to the winning hand may be determined at block 396. At block 398, the player's cumulative value or number of credits may be updated by subtracting the bet made by the player and adding, if the hand was a winner, the payout value determined at block 396. The cumulative value or number of credits may also be displayed in the display area 366 (FIG. 6).

Although the video poker routine 210 is described above in connection with a single poker hand of five cards, the routine 210 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 7:
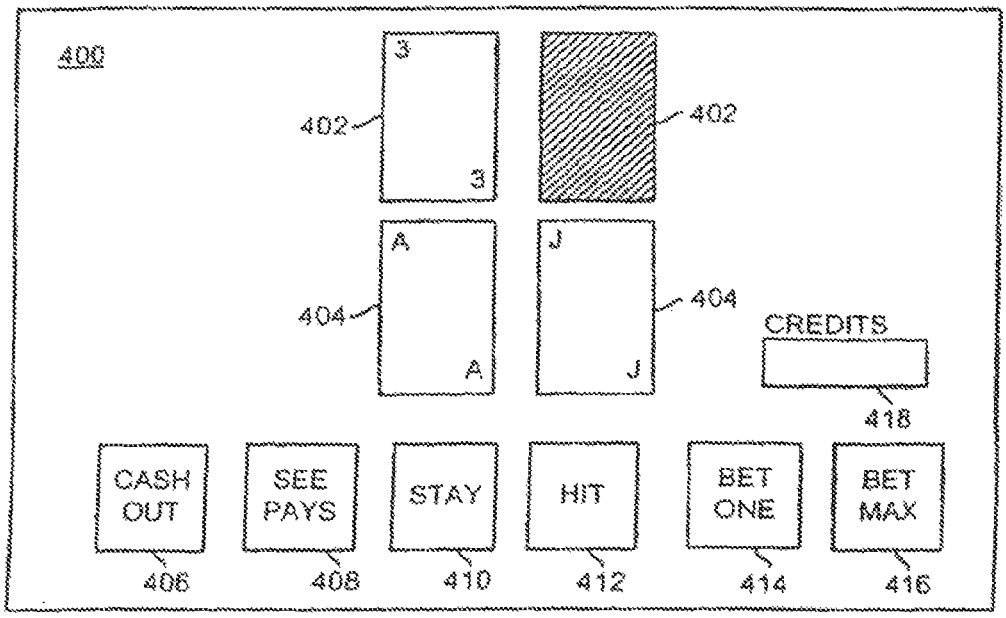
FIG. 7 is an illustration of an embodiment of a visual display that may be displayed during performance of the video blackjack routine of FIG. 9.

FIG. 7 is an exemplary display 400 that may be shown on the display unit 70 during performance of the video blackjack routine 220 shown schematically in FIG. 4. Referring to FIG. 7, the display 400 may include video images 402 of a pair of playing cards representing a dealer's hand, with one of the cards shown face up and the other card being shown face down, and video images 404 of a pair of playing cards representing a player's hand, with both the cards shown face up. The "dealer" may be the gaming unit 20.

To allow the player to control the play of the video blackjack game, a plurality of player-selectable buttons may be displayed. The buttons may include a "Cash Out" button 406, a "See Pays" button 408, a "Stay" button 410, a "Hit" button 412, a "Bet One Credit" button 414, and a "Bet Max Credits" button 416. The display 400 may also include an area 418 in which the number of remaining credits or value is displayed. If the display unit 70 is provided with a touch-sensitive screen, the buttons 406, 408, 410, 412, 414, 416 may form part of the video display 400. Alternatively, one or more of those buttons may be provided as part of a control panel that is provided separately from the display unit 70.

Figure 9:
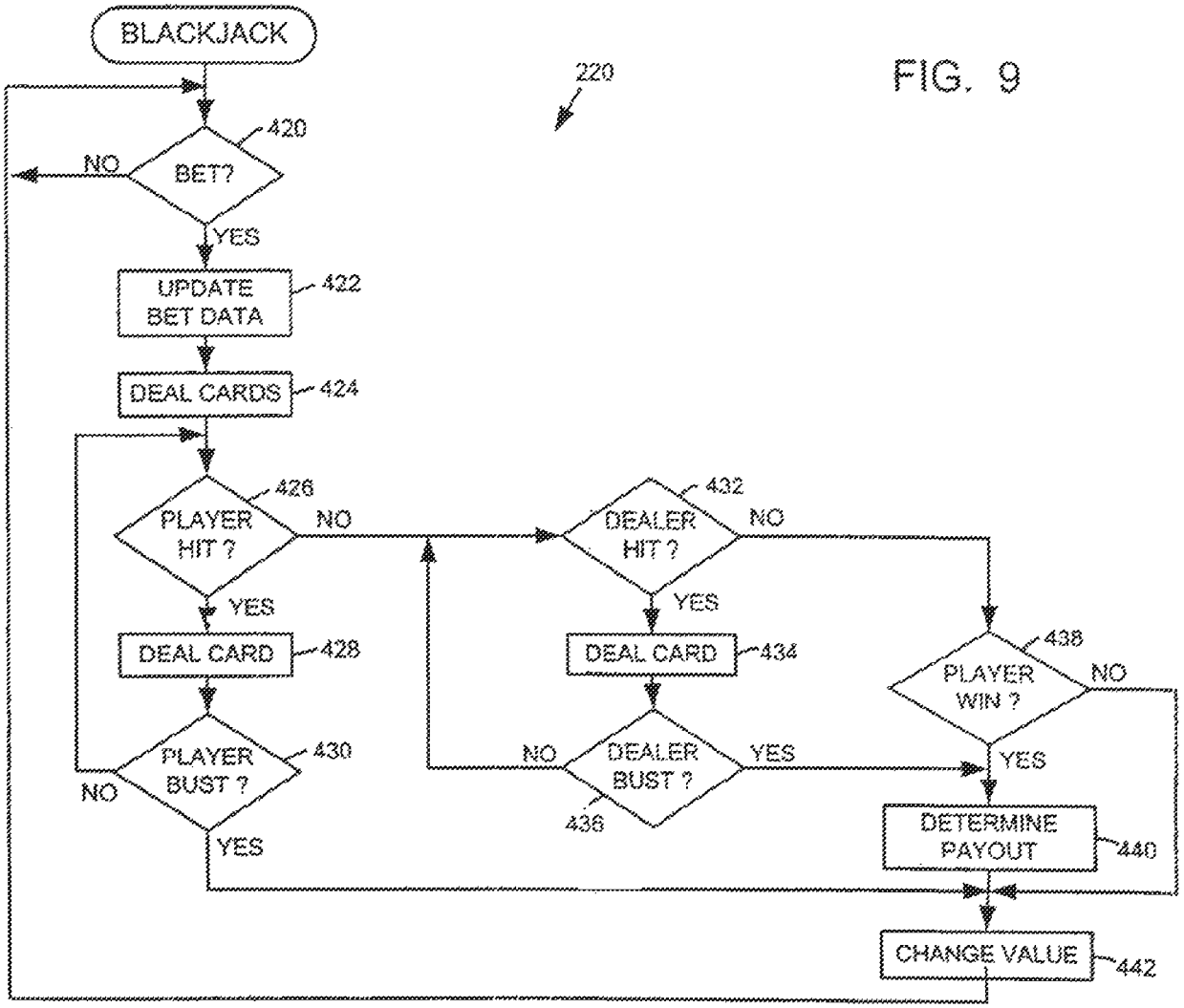
FIG. 9 is a flowchart of an embodiment of a video blackjack routine that may be performed by one or more of the gaming units.

FIG. 9 is a flowchart of the video blackjack routine 220 shown schematically in FIG. 4. Referring to FIG. 9, the video blackjack routine 220 may begin at block 420 where it may determine whether a bet has been made by the player. That may be determined, for example, by detecting the activation of either the "Bet One Credit" button 414 or the "Bet Max Credits" button 416. At block 422, bet data corresponding to the bet made at block 420 may be stored in the memory of the controller 100 and may also be communicated to one or more of the network computers 22, 32 and/or to the other gaming units 20, 30, for example, in order to communicate an amount of a progressive shared jackpot. At block 424, a dealer's hand and a player's hand may be "dealt" by making the playing card images 402, 404 appear on the display unit 70.

At block 426, the player may be allowed to be "hit," in which case at block 428 another card will be dealt to the player's hand by making another playing card image 404 appear in the display 400. If the player is hit, block 430 may determine if the player has "bust," or exceeded 21. If the player has not bust, blocks 426 and 428 may be performed again to allow the player to be hit again.

If the player decides not to hit, at block 432 the routine may determine whether the dealer should be hit. Whether the dealer hits may be determined in accordance with predetermined rules, such as the dealer always hit if the dealer's hand totals 15 or less. If the dealer hits, at block 434 the dealer's hand may be dealt another card by making another playing card image 402 appear in the display 400. At block 436 the routine may determine whether the dealer has bust. If the dealer has not bust, blocks 432, 434 may be performed again to allow the dealer to be hit again.

If the dealer does not hit, at block 436 the outcome of the blackjack game and a corresponding payout may be determined based on, for example, whether the player or the dealer has the higher hand that does not exceed 21. If the player has a winning hand, a payout value corresponding to the winning hand may be determined at block 440. At block 442, the player's cumulative value or number of credits may be updated by subtracting the bet made by the player and adding, if the player won, the payout value determined at block 440. The cumulative value or number of credits may also be displayed in the display area 418 (FIG. 7).

Slots

FIG. 10 is an exemplary display 450 that may be shown on the display unit 70 during performance of the slots routine 230 shown schematically in FIG. 4. Referring to FIG. 10, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized.

To allow the player to control the play of the slots game, a plurality of player-selectable buttons may be displayed. The buttons may include a "Cash Out" button 456, a "See Pays" button 458, a plurality of payline-selection election buttons 460 each of which allows the player to select a different number of paylines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 12:
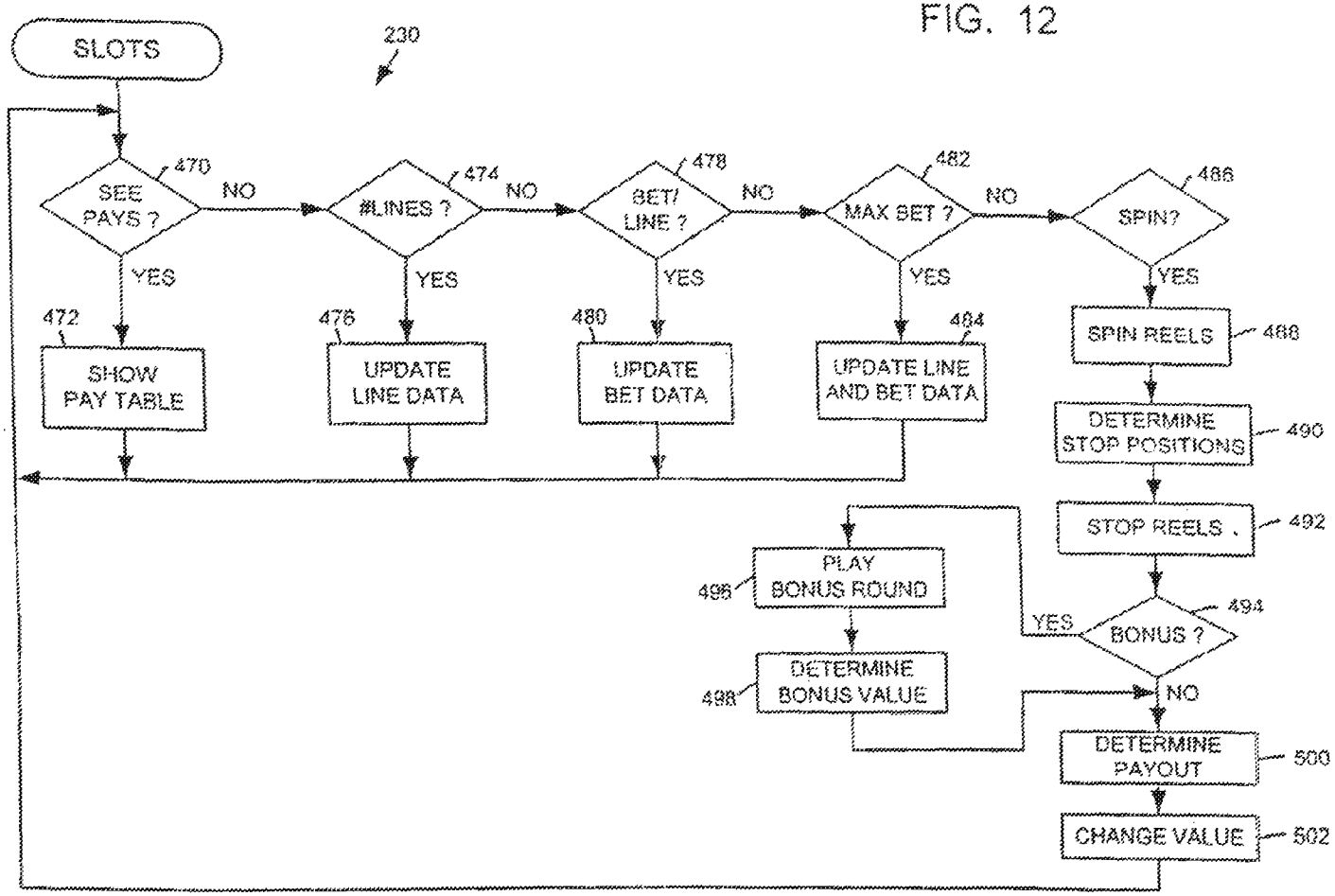
FIG. 12 is a flowchart of an embodiment of a slots routine that may be performed by one or more of the gaming units.

FIG. 12 is a flowchart of the slots routine 230 shown schematically in FIG. 10. Referring to FIG. 12, at block 470, the routine may determine whether the player has requested payout information, such as by activating the "See Pays" button 458, in which case at block 472 the routine may cause one or more pay tables to be displayed on the display unit 70. At block 474, the routine may determine whether the player has pressed one of the payline-selection buttons 460, in which case at block 476 data corresponding to the number of paylines selected by the player may be stored in the memory of the controller 100. At block 478, the routine may determine whether the player has pressed one of the bet-selection buttons 462, in which case at block 480 data corresponding to the amount bet per payline may be stored in the memory of the controller 100 and may also be communicated to one or more of the network computers 22, 32 and/or to the other gaming units 20, 30, for example, in order to communicate an amount of a progressive shared jackpot. At block 482, the routine may determine whether the player has pressed the "Max Bet" button 466, in which case at block 484 bet data (which may include both payline data and bet-per-payline data) corresponding to the maximum allowable bet may be stored in the memory of the controller 100 and may also be communicated to one or more of the network computers 22, 32 and/or to the other gaming units 20, 30, for example, in order to communicate an amount of a progressive shared jackpot.

If the "Spin" button 464 has been activated by the player as determined at block 486, at block 488 the routine may cause the slot machine reel images 452 to begin "spinning" so as to simulate the appearance of a plurality of spinning mechanical slot machine reels. At block 490, the routine may determine the positions at which the slot machine reel images will stop, or the particular symbol images 454 that will be displayed when the reel images 452 stop spinning. At block 492, the routine may stop the reel images 452 from spinning by displaying stationary reel images 452 and images of three symbols 454 for each stopped reel image 452. The virtual reels may be stopped from left to right, from the perspective of the player, or in any other manner or sequence.

The routine may provide for the possibility of a bonus game or round if certain conditions are met, such as the display in the stopped reel images 452 of a particular symbol 454. If there is such a bonus condition as determined at block 494, the routine may proceed to block 496 where a bonus round may be played. The bonus round may be a different game than slots, and many other types of bonus games could be provided. If the player wins the bonus round, or receives additional credits or points in the bonus round, a bonus value may be determined at block 498. A payout value corresponding to outcome of the slots game and/or the bonus round may be determined at block 500. At block 502, the player's cumulative value or number of credits may be updated by subtracting the bet made by the player and adding, if the slot game and/or bonus round was a winner, the payout value determined at block 500.

Although the above routine has been described as a virtual slot machine routine in which slot machine reels are represented as images on the display unit 70, actual slot machine reels that are capable of being spun may be utilized instead.

Video Keno

FIG. 11 is an exemplary display 520 that may be shown on the display unit 70 during performance of the video keno routine 240 shown schematically in FIG. 4. Referring to FIG. 11, the display 520 may include a video image 522 of a plurality of numbers that were selected by the player prior to the start of a keno game and a video image 524 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 526, a "See Pays" button 528, a "Bet One Credit" button 530, a "Bet Max Credits" button 532, a "Select Ticket" button 534, a "Select Number" button 536, and a "Play" button 538. The display 520 may also include an area 540 in which the number of remaining credits or value is displayed. If the display unit 70 is provided with a touch-sensitive screen, the buttons may form part of the video display 520. Alternatively, one or more of those buttons may be provided as part of a control panel that is provided separately from the display unit 70.

Figure 13:
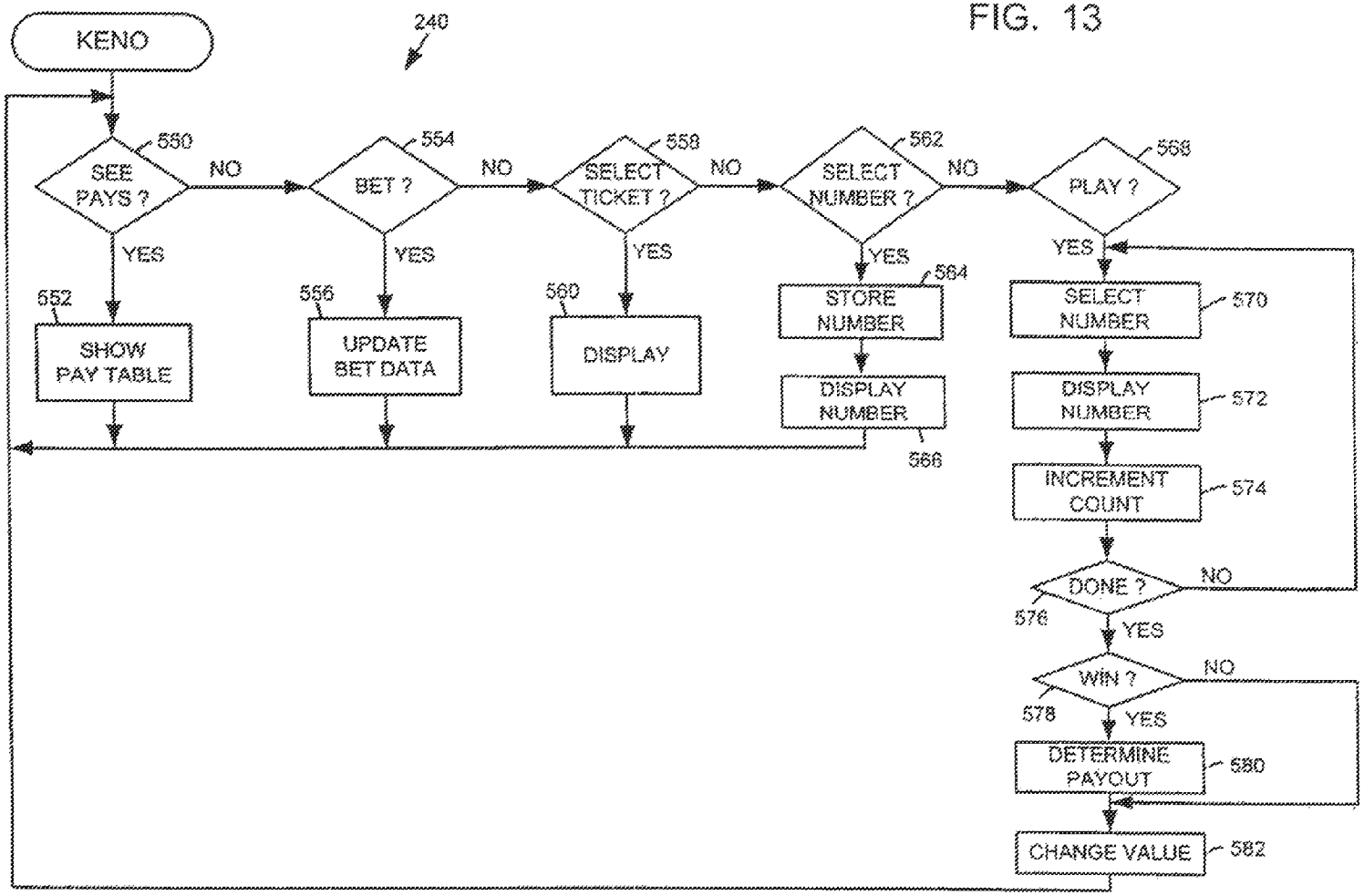
FIG. 13 is a flowchart of an embodiment of a video keno routine that may be performed by one or more of the gaming units.

FIG. 13 is a flowchart of the video keno routine 240 shown schematically in FIG. 4. The keno routine 240 may be utilized in connection with a single gaming unit 20 where a single player is playing a keno game, or the keno routine 240 may be utilized in connection with multiple gaming units 20 where multiple players are playing a single keno game. In the latter case, one or more of the acts described below may be performed either by the controller 100 in each gaming unit or by one of the network computer 22, 32 to which multiple gaming units 20 are operatively connected.

Referring to FIG. 13, at block 550, the routine may determine whether the player has requested payout information, such as by activating the "See Pays" button 528, in which case at block 552 the routine may cause one or more pay tables to be displayed on the display unit 70. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the controller 100 and may also be communicated to one or more of the network computers 22, 32 and/or to the other gaming units 20, 30, for example, in order to communicate an amount of a progressive shared jackpot. After the player has made a wager, at block 558 the player may select a keno ticket, and at block 560 the ticket may be displayed on the display 520. At block 562, the player may select one or more game numbers, which may be within a range set by the casino. After being selected, the player's game numbers may be stored in the memory of the controller 100 at block 564 and may be included in the image 522 on the display 520 at block 566. After a certain amount of time, the keno game may be closed to additional players (where a number of players are playing a single keno game using multiple gaming units 20).

If play of the keno game is to begin as determined at block 568, at block 570 a game number within a range set by the casino may be randomly selected either by the controller 100 or a central computer operatively connected to the controller, such as one of the network computers 22, 32. At block 572, the randomly selected game number may be displayed on the display unit 70 and the display units 70 of other gaming units 20 (if any) which are involved in the same keno game. At block 574, the controller 100 (or the central computer noted above) may increment a count which keeps track of how many game numbers have been selected at block 570.

At block 576, the controller 100 (or one of the network computers 22, 32) may determine whether a maximum number of game numbers within the range have been randomly selected. If not, another game number may be randomly selected at block 570. If the maximum number of game numbers has been selected, at block 578 the controller 100 (or a central computer) may determine whether there are a sufficient number of matches between the game numbers selected by the player and the game numbers selected at block 570 to cause the player to win. The number of matches may depend on how many numbers the player selected and the particular keno rules being used.

If there are a sufficient number of matches, a payout may be determined at block 580 to compensate the player for winning the game. The payout may depend on the number of matches between the game numbers selected by the player and the game numbers randomly selected at block 570. At block 582, the player's cumulative value or number of credits may be updated by subtracting the bet made by the player and adding, if the keno game was won, the payout value determined at block 580. The cumulative value or number of credits may also be displayed in the display area 540 (FIG. 11).

Video Bingo

Figure 14:
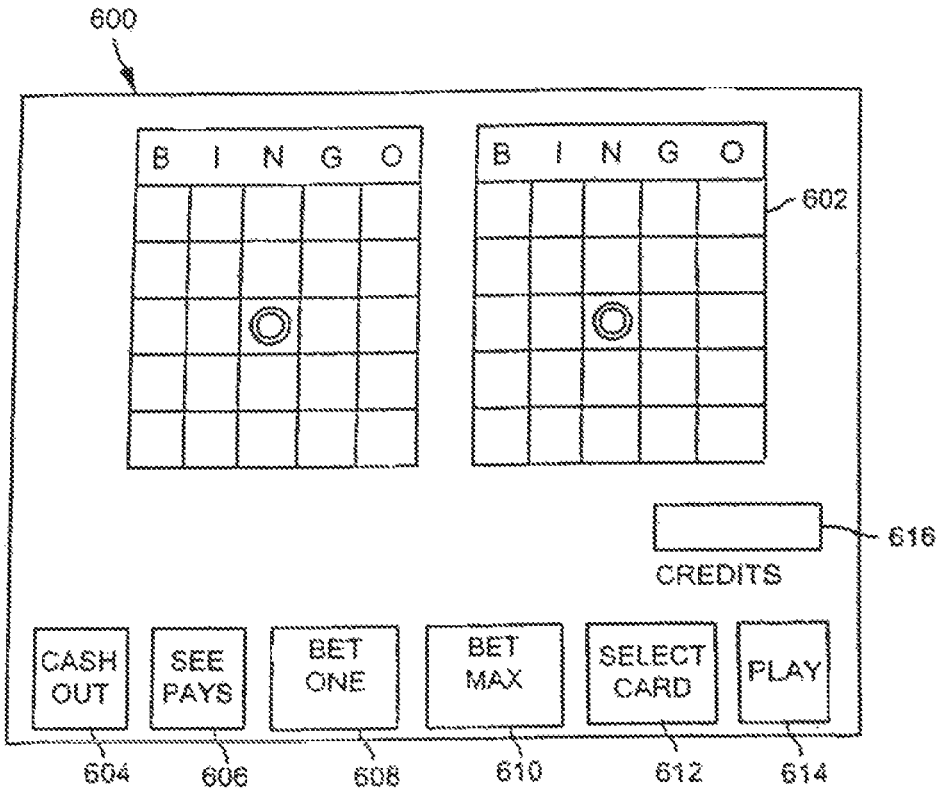
FIG. 14 is an illustration of an embodiment of a visual display that may be displayed during performance of the video bingo routine of FIG. 15.

FIG. 14 is an exemplary display 600 that may be shown on the display unit 70 during performance of the video bingo routine 250 shown schematically in FIG. 4. Referring to FIG. 14, the display 600 may include one or more video images 602 of a bingo card and images of the bingo numbers selected during the game. The bingo card images 602 may have a grid pattern.

To allow the player to control the play of the bingo game, a plurality of player-selectable buttons may be displayed. The buttons may include a "Cash Out" button 604, a "See Pays" button 606, a "Bet One Credit" button 608, a "Bet Max Credits" button 610, a "Select Card" button 612, and a "Play" button 614. The display 600 may also include an area 616 in which the number of remaining credits or value is displayed. If the display unit 70 is provided with a touch-sensitive screen, the buttons may form part of the video display 600. Alternatively, one or more of those buttons may be provided as part of a control panel that is provided separately from the display unit 70.

Figure 15:
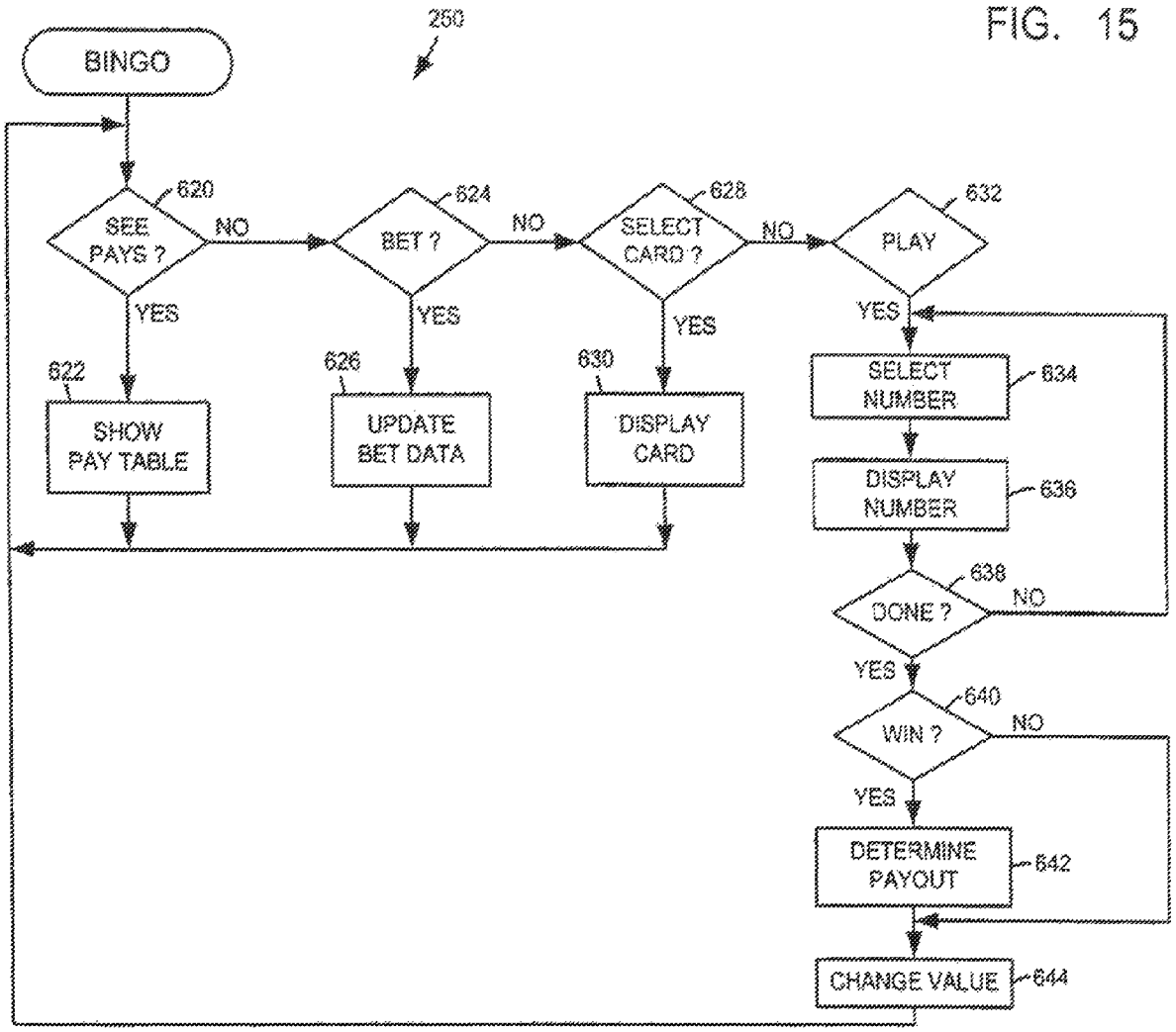
FIG. 15 is a flowchart of an embodiment of a video bingo routine that may be performed by one or more of the gaming units.

FIG. 15 is a flowchart of the video bingo routine 250 shown schematically in FIG. 4. The bingo routine 250 may be utilized in connection with a single gaming unit 20 where a single player is playing a bingo game, or the bingo routine 250 may be utilized in connection with multiple gaming units 20 where multiple players are playing a single bingo game. In the latter case, one or more of the acts described below may be performed either by the controller 100 in each gaming unit 20 or by one of the network computers 22, 32 to which multiple gaming units 20 are operatively connected. Referring to FIG. 15, at block 620, the routine may determine whether the player has requested payout information, such as by activating the "See Pays" button 606, in which case at block 622 the routine may cause one or more pay tables to be displayed on the display unit 70. At block 624, the routine may determine whether the player has made a bet, such as by having pressed the "Bet One Credit" button 608 or the "Bet Max Credits" button 610, in which case at block 626 bet data corresponding to the bet made by the player may be stored in the memory of the controller 100 and may also be communicated to one or more of the network computers 22, 32 and/or to the other gaming units 20, 30, for example, in order to communicate an amount of a progressive shared jackpot.

After the player has made a wager, at block 628 the player may select a bingo card, which may be generated randomly. The player may select more than one bingo card, and there may be a maximum number of bingo cards that a player may select. After play is to commence as determined at block 632, at block 634 a bingo number may be randomly generated by the controller 100 or a central computer such as one of the network computers 22, 32. At block 636, the bingo number may be displayed on the display unit 70 and the display units 70 of any other gaming units 20 involved in the bingo game.

At block 638, the controller 100 (or a central computer) may determine whether any player has won the bingo game. If no player has won, another bingo number may be randomly selected at block 634. If any player has bingo as determined at block 638, the routine may determine at block 640 whether the player playing that gaming unit 20 was the winner. If so, at block 642 a payout for the player may be determined. The payout may depend on the number of random numbers that were drawn before there was a winner, the total number of winners (if there was more than one player), and the amount of money that was wagered on the game. At block 644, the player's cumulative value or number of credits may be updated by subtracting the bet made by the player and adding, if the bingo game was won, the payout value determined at block 642. The cumulative value or number of credits may also be displayed in the display area 616 (FIG. 14).

Distributed Jackpot Routines

Figure 16:
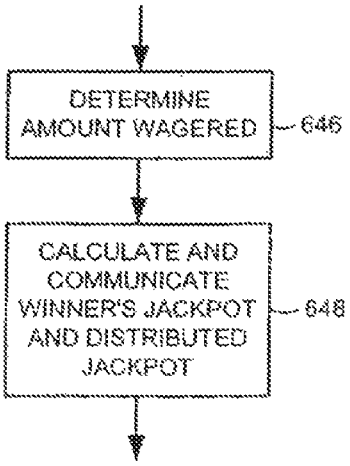
FIG. 16 is a flowchart of an embodiment of a wagering routine for the establishment of a winner's jackpot and a distributed jackpot.

FIG. 16 is a flow chart that depicts steps that may be taken to establish a winner's jackpot and a distributed jackpot. The distributed jackpot provides the capability to coordinate payouts on a group of gaming units such that when one player on one of the gaming units in the group wins an award everyone else that is playing on other gaming units in the group shares a percentage of the award. At block 646, an amount wagered by a player at one of the gaming units 20, 30 may be determined by the controller 100. The amount wagered, a fraction of the wager to be allocated to the winner's jackpot (e.g., 95% of the amount wagered), and a fraction of the wager to be allocated to the distributed jackpot (e.g., 5% of the amount wagered), may then be calculated by the controller 100 and communicated to the network computer 22 by the gaming unit 20 or 30, at block 648. Alternatively, the network computer 22 could calculate the fraction of the wager to be allocated to the distributed jackpot. In the event that the network computer 22 is located at a separate facility from the gaming unit 20 or 30 at which the wager is made, the actual payment for the progressive jackpot amount may be sent from the facility at which the gaming unit 20 or 30 is located (e.g., at a casino) to the facility at which the network computer 22 is located (e.g., at a host company).

The steps of blocks 646 and 648 could be performed in any portion of the gaming routines described above. For example, the steps of blocks 646 and 648 could be performed between blocks 422 and 424 of FIG. 9, or before block 486 of FIG. 12.

Figure 17:
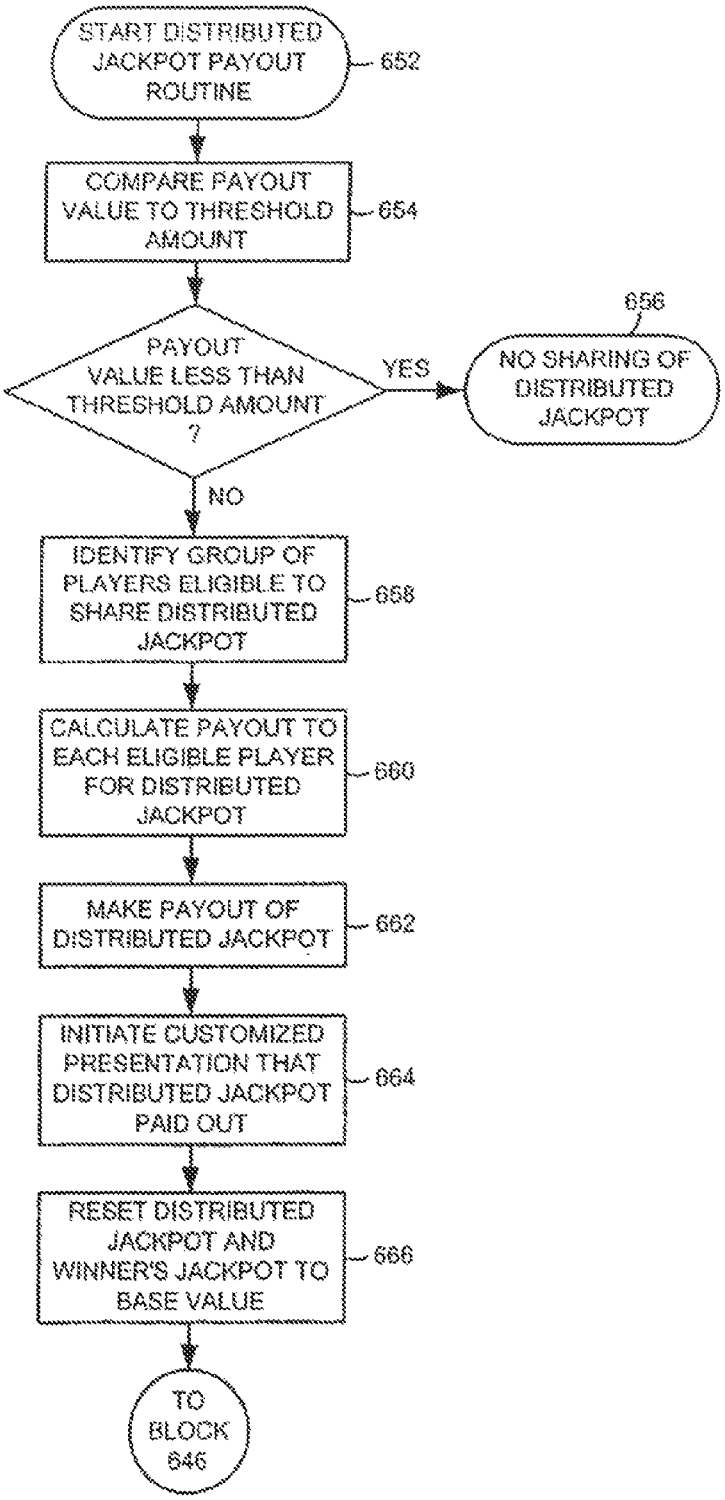
FIG. 17 is a flowchart of an embodiment of a payout routine for the distribution of the winner's jackpot and the distributed jackpot.

With reference to FIG. 17, in the event of a winning outcome at one of the gaming units 20 or 30, a distributed jackpot payout routine may be initiated, as indicated at block 652. The distributed jackpot payout routine may be performed at any appropriate stage of any of the five gaming routines described above. For example, the distributed jackpot payout routine could be performed as part of block 394 of the video poker routine 210 (FIG. 8), as part of block 438 of the video blackjack routine 220 (FIG. 9), as part of block 500 of the video slots routine 230 (FIG. 12), as part of block 578 of the video keno routine 240 (FIG. 13), and/or as part of block 640 of the video bingo routine (FIG. 15).

With reference again to FIG. 17, at block 654, the payout value, such as, for example, the payout value determined in block 580 (FIG. 13) may be compared with a threshold amount by the controller 100. If the payout value is less than the threshold amount, no sharing of a jackpot may occur, as indicated at block 656.

If the payout value equals or exceeds the threshold amount, the identity of the group of players eligible for a portion of the distributed jackpot at the time of the payout may be determined, at block 658. For example, if all of the gaming units 20 are potentially eligible for a portion of the distributed jackpot, the network computer 22 could identify those gaming units 20 that are performing one of the game routines 210, 220, 230, 240, or 250 (FIG. 4), and designate those gaming units as "in play" and therefore eligible to share in the distributed jackpot. Alternatively, each gaming unit 20 could be determined to be "in play," and therefore eligible to share in the distributed jackpot, if there are credits on the gaming unit 20 or if there is a player tracking card in the gaming unit 20.

At block 660, the value of the distributed payout to each player in the group determined to be eligible may be calculated, for example, by taking a percentage of the distributed jackpot (e.g., 5%), which may be fixed or varied (for example, as a function of time or as a function of the size of the distributed jackpot), and dividing that percentage of the distributed jackpot by the number of eligible players in the group. At block 662, the payout of the distributed jackpot may be made to each eligible player in the group.

A customized presentation (that may include text messages, graphics, and/or sounds) may be displayed on each of the gaming units 20 to communicate to the players operating those gaming units 20 that a distributed jackpot payout has been made, as indicated at block 664. The distributed jackpot and the winner's jackpot may then each be reset to a corresponding base value, as indicated at block 666, and the process may return to block 646 (FIG. 16).

The winner's jackpot may be advertised as the payout that will occur after subtracting the distributed jackpot. If done, this may avoid confusion and/or disappointment on the part of the winner that might otherwise occur if the entire jackpot amount (the winner's jackpot plus the distributed jackpot) were advertised.

The invention is claimed as follows:

1. A gaming system server comprising:

at least one processor connected to a network; and at least one memory device which stores a plurality of instructions, which when executed by the at least one processor, cause the at least one processor to:

determine if a triggering event occurs in association with a play of a game of a first one of a plurality of gaming machines connected to the network, responsive to the triggering event occurring and a value of an award associated with the occurrence of the triggering event being at least equal to a threshold value greater than zero:

cause a display device of the first one of the gaming machines to display a first part of the award associated with the occurrence of the triggering event, wherein said first part of the award associated with the occurrence of the triggering event is less than an entire award associated with the occurrence of the triggering event, cause the display device of the first one of the gaming machines to display an increase of a credit balance of the first one of the gaming machines based, at least in part, on the first part of the award associated with the occurrence of the triggering event, wherein the credit balance is increasable responsive to receipt, via an acceptor, of a physical item associated with a monetary value and the credit balance is decreasable responsive to receipt of a cashout input, cause a display device of a second one of the gaming machines to display a second part of the award associated with the occurrence of the triggering event, wherein said second part of the award associated with the occurrence of the triggering event is less than the entire award associated with the occurrence of the triggering event, and cause the display device of the second one of the gaming machines to display an increase of a credit balance of the second one of the gaming machines based, at least in part, on the second part of the award associated with the occurrence of the triggering event, and responsive to the triggering event occurring and the value of the award associated with the occurrence of the triggering event being less than the threshold value:

cause the display device of the first one of the gaming machines to display the entire award associated with the occurrence of the triggering event, and cause the display device of the first one of the gaming machines to display an increase of the credit balance of the first one of the gaming machines based, at least in part, on the entire award associated with the occurrence of the triggering event.

2. The gaming system server of claim 1, wherein said first part of the award associated with the occurrence of the triggering event is at least one selected from the group consisting of: a predetermined award, an award determined based on time and an award determined based on the value of the award associated with the occurrence of the triggering event.

3. The gaming system server of claim 1, wherein said second part of the award associated with the occurrence of the triggering event is at least one selected from the group consisting of: a predetermined award, an award determined based on time and an award determined based on the value of the award associated with the occurrence of the triggering event.

4. The gaming system server of claim 1, wherein the award associated with the occurrence of the triggering event is a progressive award.

5. The gaming system server of claim 1, wherein when executed by the at least one processor responsive to the triggering event occurring and the value of the award associated with the occurrence of the triggering event being at least equal to the threshold value, the plurality of instructions cause the at least one processor to cause a display device of a third one of the gaming machines to: (i) display a third part of the award associated with the occurrence of the triggering event, wherein said third part of the award associated with the occurrence of the triggering event is less than the entire award associated with the occurrence of the triggering event, and (ii) display an increase of a credit balance of the third one of the gaming machines based, at least in part, on the third part of the award associated with the occurrence of the triggering event.

6. The gaming system server of claim 5, wherein the second part of the award is different from the third part of the award.

7. The gaming system server of claim 1, wherein a sum of the first part of the award associated with the occurrence of the triggering event and the second part of the award associated with the occurrence of the triggering event is equal to the entire award associated with the occurrence of the triggering event.

8. A gaming system comprising:

a plurality of input devices including an acceptor;

at least one display device;

at least one processor; and at least one memory device which stores a plurality of instructions, which when executed by the at least one processor, cause the at least one processor to:

responsive to a physical item being received via the acceptor, establish a credit balance based, at least in part, on a monetary value associated with the received physical item, for a play of a game:

determine a game outcome, cause the at least one display device to display the determined game outcome, determine any award associated with the determined game outcome, and cause the at least one display device to display any determined award associated with the determined game outcome, responsive to a triggering event occurring and a value of an award associated with the occurrence of the triggering event being at least equal to a threshold value greater than zero:

cause the at least one display device to display a first part of the award associated with the occurrence of the triggering event, wherein said first part of the award associated with the occurrence of the triggering event is less than an entire award associated with the occurrence of the triggering event, and cause the at least one display device to display an increase of the credit balance based, at least in part, on the first part of the award associated with the occurrence of the triggering event, responsive to the triggering event occurring and the value of the award associated with the occurrence of the triggering event being less than the threshold value:

cause the at least one display device to display the entire award associated with the occurrence of the triggering event, and cause the at least one display device to display an increase of the credit balance based, at least in part, on the entire award associated with the occurrence of the triggering event, and responsive to a cashout input being received, cause an initiation of any payout associated with the credit balance.

9. The gaming system of claim 8, wherein said first part of the award associated with the occurrence of the triggering event is at least one selected from the group consisting of: a predetermined award, an award determined based on time and an award determined based on the value of the award associated with the occurrence of the triggering event.

10. The gaming system of claim 8, wherein the award associated with the occurrence of the triggering event is a progressive award.

11. A method of operating a gaming system, said method comprising:

causing at least one processor connected to a network to execute a plurality of instructions to determine if a triggering event occurs in association with a play of a game of a first one of a plurality of gaming machines connected to thenetwork, responsive to the triggering event occurring and a value of an award associated with the occurrence of the triggering event being at least equal to a threshold value greater than zero:

causing a display, by a display device of the first one of the gaming machines, of a first part of the award associated with the occurrence of the triggering event, wherein said first part of the award associated with the occurrence of the triggering event is less than an entire award associated with the occurrence of the triggering event, causing a display, by the display device of the first one of the gaming machines, of an increase of a credit balance of the first one of the gaming machines based, at least in part, on the first part of the award associated with the occurrence of the triggering event, wherein the credit balance is increasable responsive to receipt, via an acceptor, of a physical item associated with a monetary value and the credit balance is decreasable responsive to receipt of a cashout input, causing a display, by a display device of a second one of the gaming machines, of a second part of the award associated with the occurrence of the triggering event, wherein said second part of the award associated with the occurrence of the triggering event is less than the entire award associated with the occurrence of the triggering event, and causing a display, by the display device of the second one of the gaming machines, of an increase of a credit balance of the second one of the gaming machines based, at least in part, on the second part of the award associated with the occurrence of the triggering event, and responsive to the triggering event occurring and the value of the award associated with the occurrence of the triggering event being less than the threshold value:

causing a display, by the display device of the first one of the gaming machines, of the entire award associated with the occurrence of the triggering event, and causing a display, by the display device of the first one of the gaming machines, of an increase of the credit balance of the first one of the gaming machines based, at least in part, on the entire award associated with the occurrence of the triggering event.

12. The method of claim 11, wherein said first part of the award associated with the occurrence of the triggering event is at least one selected from the group consisting of: a predetermined award, an award determined based on time and an award determined based on the value of the award associated with the occurrence of the triggering event.

13. The method of claim 11, wherein said second part of the award associated with the occurrence of the triggering event is at least one selected from the group consisting of: a predetermined award, an award determined based on time and an award determined based on the value of the award associated with the occurrence of the triggering event.

14. The method of claim 11, wherein the award associated with the occurrence of the triggering event is a progressive award.

15. The method of claim 11, further comprising, responsive to the triggering event occurring and the value of the award associated with the occurrence of the triggering event being at least equal to the threshold value, causing a display, by a display device of a third one of the gaming machines, of a third part of the award associated with the occurrence of the triggering event, wherein said third part of the award associated with the occurrence of the triggering event is less than the entire award associated with the occurrence of the triggering event, and causing a display, by the display device of the third one of the gaming machines, of an increase of a credit balance of the third one of the gaming machines based, at least in part, on the third part of the award associated with the occurrence of the triggering event.

16. The method of claim 15, wherein the second part of the award is different from the third part of the award.

17. The method of claim 11, wherein a sum of the first part of the award associated with the occurrence of the triggering event and the second part of the award associated with the occurrence of the triggering event is equal to the entire award associated with the occurrence of the triggering event.

18. The method of claim 17, wherein the data network is an internet.

19. The method of claim 11, which is provided through a data network.

20. The method of claim 19, wherein the data network is an internet.

21. A method of operating a gaming system, said method comprising:

responsive to a physical item being received via an acceptor, establishing a credit balance based, at least in part, on a monetary value associated with the received physical item, for a play of a game:

causing at least one processor connected to a network to execute a plurality of instructions to determine a game outcome, causing at least one display device to display the determined game outcome, causing the at least one processor to execute the plurality of instructions to determine any award associated with the determined game outcome, and causing the at least one display device to display any determined award associated with the determined game outcome, responsive to a triggering event occurring and a value of an award associated with the occurrence of the triggering event being at least equal to a threshold value greater than zero:

causing the at least one display device to display a first part of the award associated with the occurrence of the triggering event, wherein said first part of the award associated with the occurrence of the triggering event is less than an entire award associated with the occurrence of the triggering event, and causing the at least one display device to display an increase of the credit balance based, at least in part, on the first part of the award associated with the occurrence of the triggering event, and responsive to the triggering event occurring and the value of the award associated with the occurrence of the triggering event being less than the threshold value:

causing the at least one display device to display the entire award associated with the occurrence of the triggering event, and causing the at least one display device to display an increase of the credit balance based, at least in part, on the entire award associated with the occurrence of the triggering event responsive to a cashout input being received, causing an initiation of any payout associated with the credit balance.

22. The method of claim 21, wherein said first part of the award associated with the occurrence of the triggering event is at least one selected from the group consisting of: a predetermined award, an award determined based on time and an award determined based on the value of the award associated with the occurrence of the triggering event.

23. The method of claim 21, wherein the award associated with the occurrence of the triggering event is a progressive award.

24. The method of claim 21, which is provided through a data network.

* * * * *